US005745994A

United States Patent [19]

Honnorat

[11] Patent Number: 5,745,994

[45] Date of Patent: May 5, 1998

[54] PROCESS FOR MAKING A COMPOSITE ROTOR WITH METALLIC MATRIX

[75] Inventor: Yves Christian Louis Honnorat, Orsay, France

[73] Assignee: Societe Nationale d'Etude et de Construction de Moteurs d'Aviation "Snecma", Paris, France

[21] Appl. No.: 747,765

[22] Filed: Nov. 13, 1996

[30] Foreign Application Priority Data

Nov. 22, 1995 [FR] France ..... 95 13832

[51] Int. Cl.[6] ..... B23P 15/00

[52] U.S. Cl. ..... 29/889.2; 29/889.1

[58] Field of Search ..... 29/889, 419.1, 29/889.2, 557, 598

[56] References Cited

U.S. PATENT DOCUMENTS

| | | | |
|---|---|---|---|
| 4,782,992 | 11/1988 | Doble | 228/190 |
| 4,809,903 | 3/1989 | Eylon et al. | 29/419.1 |
| 4,831,707 | 5/1989 | Goddard et al. | 29/419.1 |
| 4,900,599 | 2/1990 | Doble | 428/65 |
| 5,217,770 | 6/1993 | Morris, Jr. et al. | 29/419.1 |
| 5,305,520 | 4/1994 | Doorbar et al. | 29/889.21 |
| 5,419,868 | 5/1995 | Honnorat | 419/4 |
| 5,440,806 | 8/1995 | Wei et al. | 29/889.2 |

FOREIGN PATENT DOCUMENTS

| | | |
|---|---|---|
| A-0657554 | 6/1995 | European Pat. Off. . |
| A-2289425 | 5/1976 | France . |
| A-2607071 | 5/1988 | France . |
| A-2684578 | 6/1993 | France . |

*Primary Examiner*—Irene Cuda

*Attorney, Agent, or Firm*—Oblon, Spivak, McClelland, Maier & Neustadt, P.C.

[57] ABSTRACT

Process for making a composite rotor with metallic matrix reinforced by fibrous windings. In order to prevent swelling of the windings, isostatic compression is applied when hot after laying a cap on the windings with the same surface area as the network formed by the windings, and which is compressed as degassing occurs.

2 Claims, 2 Drawing Sheets

PROCESS FOR MAKING A COMPOSITE ROTOR WITH METALLIC MATRIX

DESCRIPTION

Figure 1:
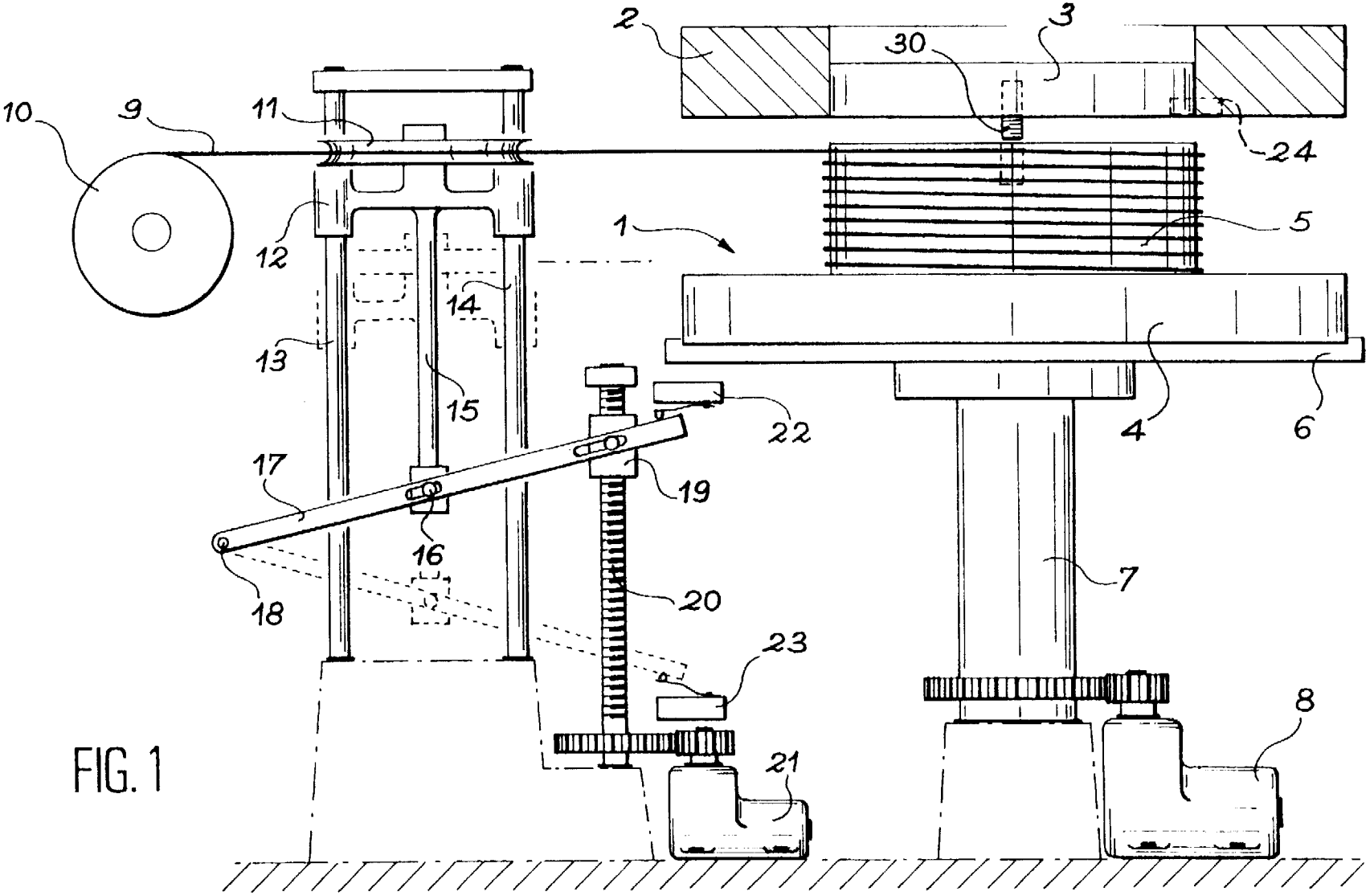
Figure 2:
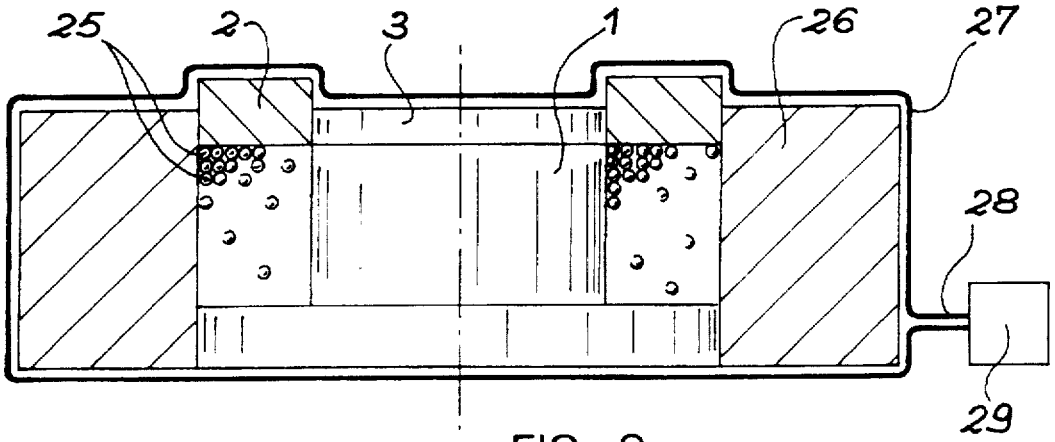

This invention concerns a process for making a composite rotor with metallic matrix.

Rotor parts formed from a single block starting from a metallic matrix which is then machined into the required shape, are fairly frequently used.

Attempts have been made to reinforce the matrix, which is often formed of a brittle alloy such as titanium and aluminum, by fibers wound in internal circles embedded in the matrix around the spindle of the rotor.

These fibers have a higher breaking strength than the matrix and a higher modulus of elasticity, and can be used to build strong high performance and fairly lightweight rotors. They are usually wound around a rotor hub and are embedded in the metallic matrix. Metallic material with exactly the same composition as the matrix is added between the fiber windings to give good cohesion. Therefore the manufacturing method requires that fiber windings are formed, that these windings are placed in the matrix material and that the assembly is combined by hot compression, causing agglomeration between the fibers and the matrix while eliminating interstices between the windings and the added metallic material. However, the fiber must be protected from swelling, i.e. irregular displacements of windings which would disturb the regularity of their position in the finished part.

It has been demonstrated that if a tensile breaking test is carried out along the direction of the fibers on a part with this type of composition, the part normally fails due to a lack of shear cohesion at the bond between the matrix and the fibers, between two failure planes of two adjacent fibers; this failure mode absorbs a large amount of energy, but only occurs if fibers are uniformly distributed. Otherwise, stress concentrations created close to a fiber extend to reach its neighbors if they are close by, with the consequence that they too will break almost immediately. It is observed that the failure propagates across the entire test piece on a plane, at a fairly low force and without the matrix material making a significant contribution to the strength.

Therefore, a number of processes have been designed to obtain a uniform layout of fiber windings. In the first process, the fiber is wound layer by layer around a mandrel and the material added to the matrix is sprayed as plasma between the turns of the exposed layer. Oblique projections in both directions are necessary to satisfactorily fill in the interstices between turns, and then additional spraying is necessary to cover the turns. This is difficult in practice and complicated.

Another idea was to place the material added to the matrix in the form of metal foil alternating with the layers of fiber turns. The metal strips could then be wound directly on the manufacturing machine, or the structure could be prepared by placing alternating flat layers of metal foil and fiber cable strips, and the winding being done in the next stage. But manufacturing difficulties were encountered with this system, in joining the ends of metal foil to prevent them from folding and to make uniform overlaps, in particular without allowing fibers to slide during winding. Stress concentrations due to structure irregularities were observed on finished parts.

Depositing alternating helical layers of fiber and metal strip as proposed in French patent 2 607 071 has similar disadvantages.

Finally, another idea was to deposit the material added on the matrix onto the fiber before forming the windings and then apply an isostatic compression to the assembly when hot. This process is described in French patent 2 684 578. It is easier in practice, but does not entirely eliminate uniformity defects on the part structure.

The origin of the invention may be seen more easily in the idea that hot isostatic compression also contributed to the appearance of structure irregularities, regardless of the process chosen for winding and the care taken in its execution. Elimination of the interstices implies that windings are tightened, and therefore that their diameter contracts causing fiber buckling deformations.

The characteristic of the invention is that it avoids these contractions of turn diameters and their consequences by means of enhanced hot compression exerted in the axial direction only.

However, perfect uniformity of the windings must also be guaranteed to prevent any swelling during hot compression, which is very difficult due to the fineness of the fibers which have a diameter on the order of 50 microns: therefore the fibers are very flexible and they have a large number of windings. A process for placing windings that are reliable and easy to use in industry would therefore be desirable; it is described below and also forms part of the invention.

The rotor with metallic matrix including fiber windings that are finally obtained, forms a unique and compact mass with much more uniformly positioned fiber windings.

The process according to the invention includes the following steps:

- build a metal hub consisting of a plate and a rod placed upright on the plate,
- place a metal disk on the rod, a metal cap being connected to the disk and extending around the disk, then:
  - wind the fibers coated with the matrix material around the rod and between the disk and the plate,
  - place a metal bushing around the plate and the fibers, the cap projecting beyond the bushing and the rod, and release the disk cap,
  - surround the hub, the bushing and the cap, using a sheath fitted with a degassing orifice,
  - compress the sheath by hot isostatic compression until the cap penetrates and reaches a given level,
  - remove the sheath and, if necessary, machine the metallic block into a required shape.

Therefore the block is formed by the agglomeration resulting from isothermal forging of the hub, the bushing, the cap and the fiber coating, which are normally formed from the same matrix material, and form a single block at the end of the process. The fibers continue to bond to their coating and are therefore perfectly integrated into the formed part.

The invention will now be described in more detail with reference to the following figures that describe one possible embodiment and are supplied for illustrative and non-restrictive purposes:

FIGS. 1, 2, 3 and 4 represent four production steps.

The metallic matrix is initially formed from four pieces, three of which are visible in FIG. 1, namely a hub 1, a cap 2 and a disk 3. The hub 1 is formed from a lower circular plate 4, to which a cylindrical rod 5 is fixed upright at the center. The cap 2 has a slightly larger diameter than rod 5, and an external diameter identical to that of plate 4. The diameter of disk 3 is similar to the diameter of rod 5. The first step is to place disk 3 on rod 5 and cap 2 around disk 3 so that it can slide around it and around rod 5, and plate 4 is placed on a support 6 such that it is coaxial with a spindle 7 on which support 6 is fixed, in the same way as cap 2, disk 3, and rod 5. A motor 8 rotates spindle 7.

A fiber 9 was prepared. It is unwound from a reel 10 turning freely, and it is passed around a pulley 11 rotating freely on a frame 12 itself mobile in translation along two vertical and parallel slides 13 and 14. The frame 12 is connected by a connecting rod 15 to an intermediate point 16 of a lever 17, one end of which is hinged to a fixed point 18 and the other end to a nut 19 free to move along a vertical lifting screw 20 driven by a motor 21. Two switches 22 and 23 sensitive to the connecting rod 17 contact are provided adjacent to the lifting screw 20 to form limit switches.

Fiber 9 is moved forwards by rotating motor 8, which unwinds it from reel 10 forming windings around rod 5. At the same time, motor 21 starts to slowly lower connecting rod 17 and therefore pulley 11 from the upper switch 22 to the lower switch 23. The pulley 11 gradually draws fiber 9 downwards and contributes to forming windings over the entire height of rod 5, between disk 3 and the plate. In this embodiment, the end of fiber 9 is trapped between disk 3 and the upper surface of the rod 5, but other methods could be considered for drawing the fiber by fixing it to parts 1, 2 and 3 of the matrix. The height of cap 2 exceeds the height of disk 3, and it is held in place so that it projects upwards around it by a retaining dowel 24 housed in a cavity formed in the lower surfaces of the cap 2 and disk 3. Another dowel 30 is used to center disk 3 on rod 5; this dowel is housed in a cavity formed on the spindle of these parts. But there are other ways of making this assembly: thus cap 2 can clamp disk 3 slightly and project slightly below it, at the top of the rod 5 which itself controls centering. The centering dowel 30 may be chosen with a diameter sufficient to drive disk 3 in rotation. In another possible embodiment, spindle 7 is replaced by a thinner spindle onto which hub 1 and disk 2 are slid, through the drillings in their centers. Unlike previous processes which are more difficult to accomplish, this process guarantees very uniform windings without the need for any dexterity. Cap 2 acts as a reel during winding and therefore prevents the wound layers from moving.

Fiber 9 is cut when the windings are made. The result is the state illustrated in FIG. 2. The centering dowel 24 is withdrawn and a bushing 26 is slid into position, which is the fourth part of the metallic matrix, around cap 2, windings 25 and plate 4; a hermetically sealed sheath 27 is then formed around the entire matrix, however after drilling a degassing duct 28 leading to pump 29. Note that when bushing 26 is placed at the same height as plate 4, its top is at the same height as disk 3 but cap 2 projects above it.

Figure 3:
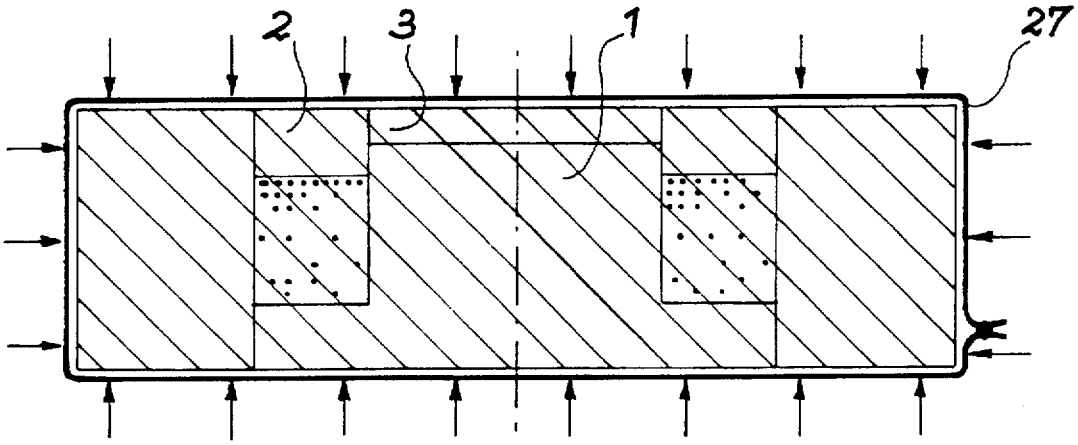

A hot isostatic compression is then made to produce a compact mass in sheath 27, as shown in FIG. 3. Hot isostatic compression processes are now well known and will not be mentioned further. In this case, the main effect obtained is an agglomeration of windings 25 resulting in a reduction of their volume and a gradual collapse of cap 2. The isostatic compression becomes a purely axial compression of windings 25 due to the continuity of bushing 26, which replaces a circle of cores used in earlier processes and which contract radially until the cores touch. The disadvantages of this radial compression for uniformity of windings 25 have already been mentioned. Swelling of the fiber is much less with the invention. It is beneficial if the height of the cap 2 is calculated so that its upper surface is flush with the upper surfaces of disk 3 and bushing 26 when satisfactory agglomeration of windings 25 has been achieved, as shown in FIG. 3. The compression can then be stopped.

Figure 4:
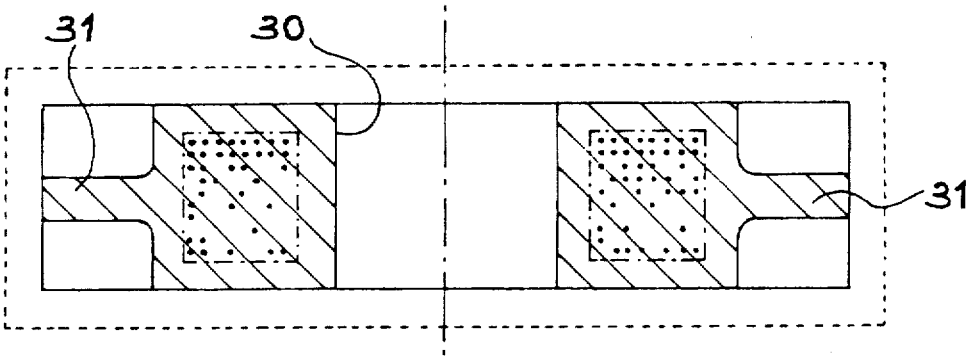

Finally, and in accordance with FIG. 4, duct 27 is formed by machining and the metallic matrix corresponding to the old parts 1, 2, 3 and 26 may be machined as necessary to form the required part.

A recess can then be formed in its spindle to form a reaming 30, and material can be removed from its external periphery so that only the blades 31 remain; more generally, the part may be machined as necessary. Note that there is a great deal of freedom as a function of the required final shape. As an alternative, parts 1, 2, 3 and 26 may be designed at the beginning with an external surface similar to the external surface of the part in its final condition; duct 27 will then have an appropriate shape.

One typical manufacturing example concerns a TAGV alloy matrix and silicon carbide SiC fibers also coated with titanium. Coatings of windings 25 form compact mass during compression. Perfect cohesion of the part is thus obtained.

I claim:

1. Process for making a composite rotor with metallic matrix composed of a metallic block containing fibers laid out in circles, including the following steps:

making a metal hub composed of a plate and a rod standing upright on the plate, placing a metal disk on the rod, a metal cap being fixed to the disk and extending around the disk, then:

winding the fibers, the fibers being coated with the matrix material, around the rod and between the disk and the plate, placing a metal bushing around the plate and fibers, the cap projecting from the bushing and the rod, in an axial direction of the rod, surrounding the hub, bushing and cap by a sheath fitted with a degassing orifice, compressing the sheath by a hot isostatic compression process until the cap, being released from the disk, sinks in the axial direction of the rod at a predetermined level into the bushing and the cap, the bushing, the hub, the disk and the fibers coalesce into the metal block, removing the sheath and if necessary machining the metallic block to a required shape.

2. Process for manufacturing a composite rotor according to claim 1, characterized in that the predetermined level corresponds to a level at which the upper surface of the cap is flush with the upper surface of the bushing.

* * * * *